United States Patent [19]

Focke et al.

[11] Patent Number: 4,819,407

[45] Date of Patent: Apr. 11, 1989

[54] PACKAGING MACHINE, ESPECIALLY FOR CIGARETTE PACKS

[75] Inventors: Heinz Focke; Jürgen Focke; Kurt Liedtke, all of Verden, Fed. Rep. of Germany

[73] Assignee: Focke & Co. (GmbH & Co.), Verden, Fed. Rep. of Germany

[21] Appl. No.: 123,479

[22] Filed: Nov. 20, 1987

[30] Foreign Application Priority Data

Nov. 22, 1986 [DE] Fed. Rep. of Germany ..... 3639994

[51] Int. Cl.[4] ..... B65B 19/00

[52] U.S. Cl. ..... 53/202; 53/234

[58] Field of Search ..... 53/202, 234, 575, 236; 198/570

[56] References Cited

U.S. PATENT DOCUMENTS

| | | | |
|---|---|---|---|
| 1,920,615 | 8/1933 | Wood | 198/570 |
| 2,622,734 | 12/1952 | Sheffield | 198/570 X |
| 2,646,162 | 7/1953 | Brunsvord | 198/570 X |
| 3,948,115 | 4/1976 | Seragnoli | 53/234 X |
| 4,079,575 | 3/1978 | Focke | 53/234 |
| 4,217,745 | 8/1980 | Watzka | 53/202 X |
| 4,269,016 | 5/1981 | Kopp | 53/202 |
| 4,617,780 | 10/1986 | Focke | 53/202 X |

*Primary Examiner*—John Sipos

*Attorney, Agent, or Firm*—Sughrue, Mion, Zinn, Macpeak & Seas

[57] ABSTRACT

A packaging machine for simultaneously producing cigarette packs in two parallel production tracks. Each track comprises a cigarette magazine, a feeding conveyor, a folding turret, a drying turret and a discharge conveyor which feeds a transverse path common to both tracks. The turrets and conveyors of each track are mounted on opposite sides of a supporting stand with the magazines and conveyors being transversely offset relative the mid-plane of the machine so that the cigarettes of the two tracks are always arranged, fed and discharged in the same orientation of the cigarettes.

8 Claims, 2 Drawing Sheets

PACKAGING MACHINE, ESPECIALLY FOR CIGARETTE PACKS

Figure 1:
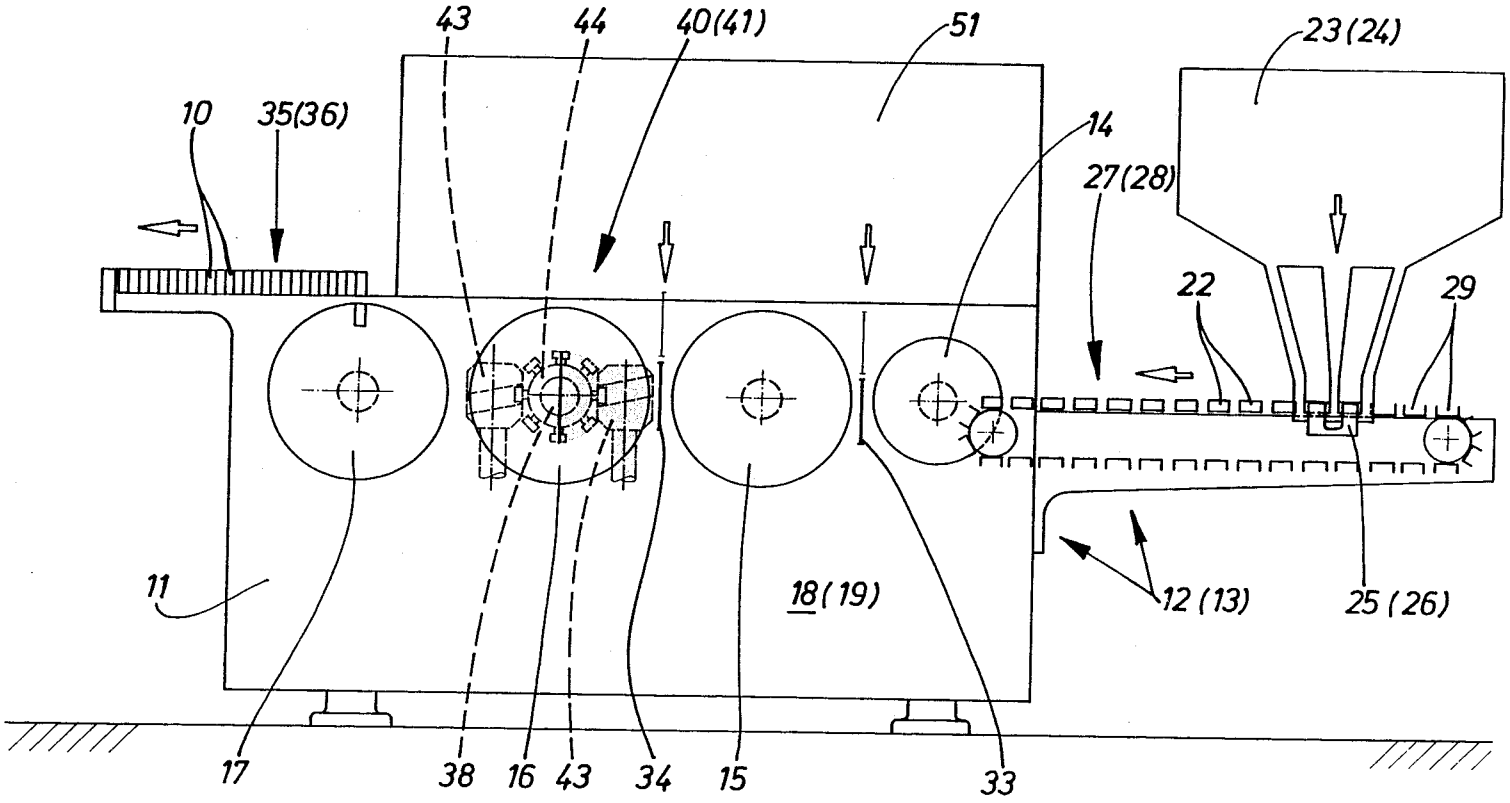

The invention relates to a packaging machine, especially for producing cigarette packs, with rotating folding units for the folding of blanks, especially folding turrets, and with conveyors for cigarette groups, packaging material and cigarette packs.

The invention is concerned with a packaging machine of conventional design, standard in terms of its individual components, intended especially for producing cigarette packs. These can be designed as soft-cup packs or as hinge-lid packs. A packaging machine for producing cigarette packs of this type consists conventionally at least of a folding turret for the inner wrapping of cigarette groups (tin foil) and of a further folding turret for wrapping these in a paper or cardboard blank. Moreover, the packaging machine can be equipped with a drying turret and with conveying members for feeding packaging material and for transporting the (part) packs.

Packaging machines of the double-track type are known. These are equipped with turrets, conveyors etc. which are intended for receiving two packs located next to one another at a time. The output of a double-track packaging machine of this kind is considerably higher than that of a "single" packaging machine. However, the double-track version is necessarily more susceptible to faults.

The object on which the invention is based is to increase the productive capacity of packaging machines, especially for cigarette packs, and reduce the effects of any faults on total output.

To achieve this object, the packaging machine according to the invention is characterized in that folding units and conveyors are arranged in two parallel production tracks on opposite sides of a common (central) supporting stand, for the simultaneous production of two packs at a time.

Thus, the packaging machine according to the invention is of two-track design. However, the two production tracks are separated from one another in mechanical and functional terms, but are nevertheless integral parts of a unified packaging machine. A complete set of the necessary folding, conveying and other members is assigned to each production track. These are arranged at a distance from one another, in particular on both sides of a common supporting stand.

According to the invention, the units and members of the two production tracks are driven independently of one another. Thus, a (momentary) reduction in output in the region of one production track has no effect on the operation, and consequently the output, in the region of the other production track. For this purpose, according to one exemplary embodiment, a separate independent drive is assigned to the folding units, conveyors, etc. of each of the two production tracks. Alternatively, a common drive can be assigned to both production tracks, in which case the units and conveyors of the two production tracks can be uncoupled individually from the common drive.

The supporting stand, on the longitudinal sides of which the folding units (folding turrets, conveyors, etc.) are mounted, is preferably at the same time a housing for receiving the drives for the folding members, conveyors, etc. of the two production tracks.

Figure 2:
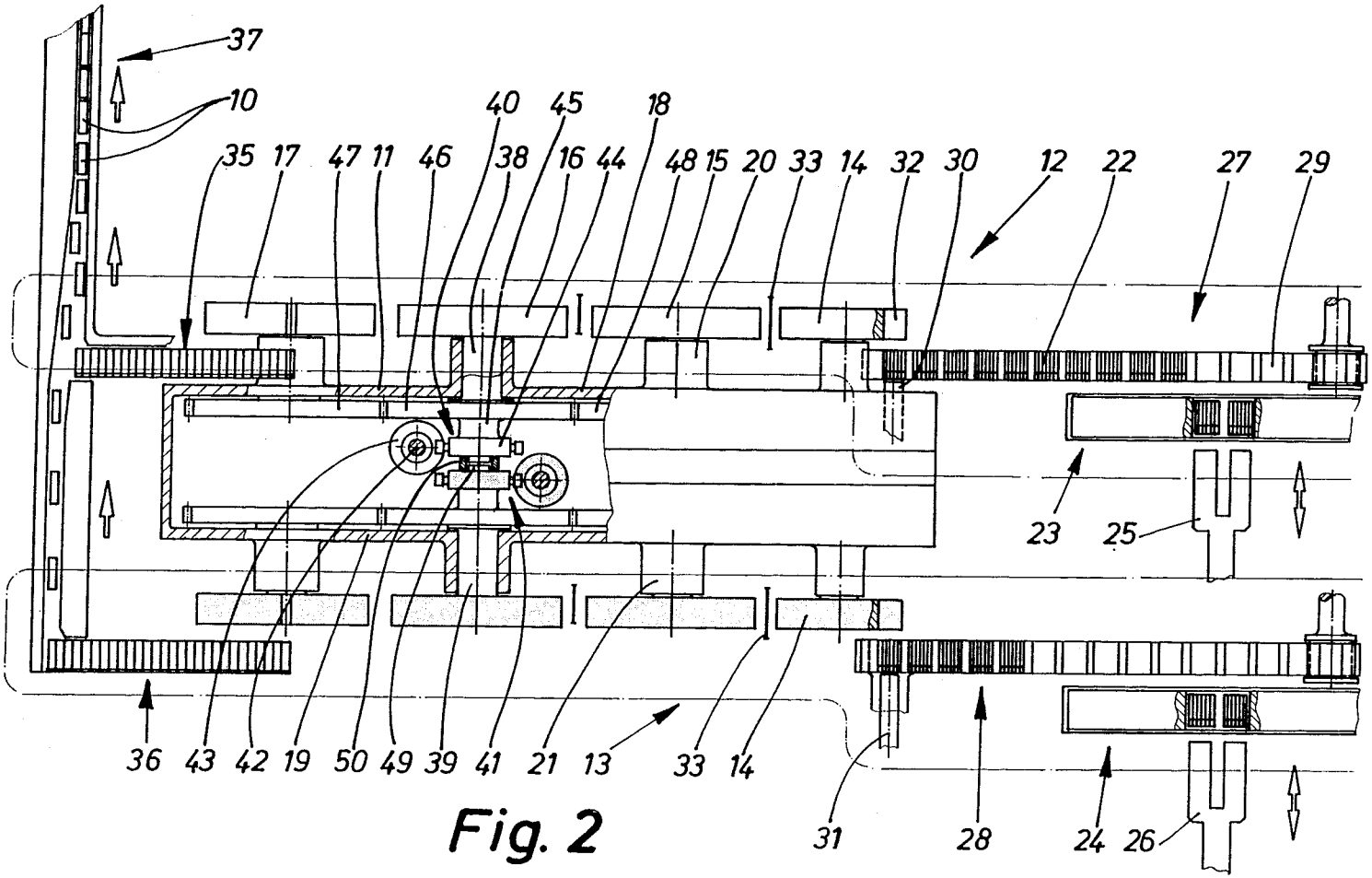

An exemplary embodiment of the invention is explained in detail below with reference to the drawings. In these, FIG. 1 shows a simplified side view of a packaging machine for cigarettes, FIG. 2 shows a plan view, partially in horizontal section, of the packaging machine according to FIG. 1.

The packaging machine shown diagrammatically in the drawings is designed for the production of cigarette packs 10 of the soft-cup type. Folding units, conveying units, etc. for two complete production tracks 12 and 13 are formed on both sides of an approximately central supporting standm, in particular a box-shaped housing 11. Each of these production tracks 12, 13 produces cigarette packs 10 independently of the other production track.

The units arranged in the region of each production track 12, 13, that is to say on both sides of the housing 11, are each complete for the purpose of the packaging operation. In the example shown, a receiving turret 14, a tin foil-folding turret 15, a paper-folding turret 16 and a drying turret 17 are mounted, in succession in the conveying direction, on the two longitudinal sides of the housing 11, in particular on side walls 18 and 19 of the latter. The abovementioned turrets 14 to 17 of the two production tracks 12 and 13 are respectively mounted equiaxially, specifically in bearing bushes 20, 21 of the housing 11. Furthermore, the turrets 14 to 17 are aligned with one another in a vertical plane, in such a way that cigarette groups 22 or (part) packs can be transferred from one turret to the other. Depending on the design of the packaging machine, the turrets 14 to 17 can be driven continuously or, as in the exemplary embodiment illustrated, intermittently.

In the present exemplary embodiment, a separate cigarette magazine 23, 24 is assigned to each production track 12, 13. Cigarette groups 22 are extracted from each of these cigarette magazines 23, 24 of conventional design by means of a double slide 25, 26 movable to and fro transversely relative to the conveying direction. In each work cycle, this fork-shaped double slide 25, 26 feeds two cigarette groups 22 into a cigarette conveyor 27, 28 which is designed, here, as a pocket chain, with pockets 29 open on the sides and at the top for receiving a cigarette group 22.

The endless cigarette conveyor 27, 28 terminates adjacent to the first turret, in particular the receiving turret 14. This is in a plane offset relative to the cigarette conveyor 27, 28, so that, by means of transversely movable pushing-out devices 30, 31, the cigarette groups 22 can be transferred from the pockets 29 of the cigarette conveyors 27, 28 to a pocket 32 of the receiving turret 14.

The cigarette groups are conveyed by the receiving turret 14 along a circular path of 180° into the immediate vicinity of the next turret, namely the tin foil-folding turret 15.

In the plane between the receiving turret 14 and the tin foil-folding turret 15, a tinfoil blank 33 is held in preparation in a vertical transverse position. When a cigarette group 22 is pushed out of the receiving turret 14 and into a pocket of the tin foil-folding turret 15, the tinfoil blank 33 wraps round the cigarette group 22 in a U-shaped manner in the known way.

During the (intermittent) rotary movement of the tin foil-folding turret 15 along a conveying path of 180°, the tin foil blank 33 is ready-folded. Cigarette groups 22 wrapped in the tin foil blank 33, that is to say tin foil blocks, are pushed out of the respective pocket of the tin foil-folding turret 15 located immediately adjacent to the paper-folding turret 16 and pushed into a pocket of the paper-folding turret 16. A further blank, in particular a paper blank 34, is thereby wrapped in turn round the tin foil block in a U-shaped manner. The paper blank 34, while being conveyed by the paper-folding turret 16, is ready-folded, in particular so as to form a soft cup.

Cigarette packs 10 which are finished, with the exception of the outer film wrapping, are ejected from the paper-folding turret 16 and at the same time introduced into a pocket of the adjacent drying turret 17. This ensures hardening or setting of glue bonds of the folding tabs which were made in the region of the paper-folding turret 16. Furthermore, the shape of the pack is stabilized in a known way in the region of the drying turret 17. The cigarette packs 10 remain in the drying turret 17 during a three-quarter revolution of the latter. Accordingly, the packs are pushed out of the drying turret at the top in the axial direction onto a discharge conveyor track 35, 36. The two discharge conveyor tracks 35, 36 lead to a transverse collecting track 37, in which the cigarettes, with the small end faces pointing in the conveying direction, are transported away. The collecting track 37 can lead to a film-wrapping machine.

The folding and conveying members of the two production tracks 12, 13 are not arranged symmetrically relative to the mid-plane of the apparatus, but are offset in parallel. It is thereby possible to arrange the cigarettes or cigarette groups 22 and the packs 10 of the two production tracks 12, 13 in the same direction or orientation of the cigarettes. Filter cigarettes are being packaged in the present case. As illustrated, the filters of the cigarettes of the two production tracks 12, 13 are directed to the same side. This means that the components are in a corresponding relative arrangement. Thus, the cigarette conveyor 27 of the production track 12 at the top (in FIG. 2) is arranged in a plane between the turrets 14 to 17 and the housing 11. The same applies to the position of the discharge conveyor track 35. As a result of this relative position, th pushing-out movements of the two pushing-out devices 30, 31 are in the same direction. The folding members of the folding turrets 15, 16 are also arranged so that they correspond to the relative position of the cigarettes and packs 10 in the same direction.

The turrets 14 to 17 are mounted rotatably by means of drive shafts 38, 39 in the associated bearing bushes 20, 21. In this exemplary embodiment, an individual drive is provided for each production track 12, 13. This is a stepping gear 40, 41 (manifold). A driver 43 driven in rotation about a vertical axle is mounted on a vertical transmission shaft 42 and is engaged with a star wheel 44. This is attached, in turn, on a shaft journal 45 of a main gearwheel 46. The drive shaft 38, 39 for the paper-folding turret 16 is also connected to this, so that the drive of the stepping gear 40, 41 is transmitted directly to the paper-folding turret 16.

Further driving gearwheels 47, 48, specifically conforming to the main gearwheel 46, are mounted within a housing 11 for each production track 12, 13 or for the associated turrets 14, 15, 17. The driving gearwheels 47, 48 are engaged with the main gearwheel 46, so that its rotary movement is transmitted to the driving gearwheels 47, 48 and finally to the turrets 14, 15 and 17.

To ensure a mounting which is perfect in static terms, the drive shafts 38, 39 arranged equiaxially are mounted rotatably, by means of journal ends 49 approximately in the middle of the housing 11, in a supporting bush 50 arranged rigidly.

The transmission shafts 42 of the two stepping gears 40, 41 can be driven by means of separate drive motors. However, a solution, in which a common drive motor is connected to the stepping gears 40, 41 via couplings, is also possible. Moreover, there is a possible solution, in which a common stepping gear, from which the members of the two production tracks 12, 13 can be uncoupled, is assigned to the two production tracks 12, 13.

For safety reasons, in the exemplary embodiment illustrated, a vertical partition wall 51 is arranged centrally on the housing 11.

As a result of the above-described design of the packaging machine, the latter has a higher output than conventional two-track packaging machines. Thus, if there are ever temporary interruptions in operation, faults, etc. in the region of one production track, the other can continue to work unrestrictedly.

We claim:

1. Packaging machine for producing cigarette packs and having rotating folding turrets for the folding of blanks and having conveyors for cigarette groups, wherein, for the simultaneous production of two cigarette packs (10) at a time, two parallel longitudinal production tracks (12, 13) are arranged on opposite sides of a common supporting stand (11);

wherein each production track (12, 13) comprises successively, in a direction from an upstream end to a downstream end of the track, a cigarette magazine (23, 24) with a feeding conveyor (27, 28), a receiving turret (14), tin foil-folding and paper-folding turrets (15, 16), a drying turret (17), and a discharging conveyor (35, 36) which feeds a transverse collecting track (37) common to both production tracks;

wherein, in the two production tracks, the mutually corresponding receiving turrets (14), folding turrets (15, 16), drying turrets (17), feeding conveyors (27, 28) and discharging conveyors (35, 36) are mounted equiaxially on respective opposite transversely-spaced sides of the supporting stand (11); and wherein the cigarette magazines (23, 24) and the feeding (27, 28) and discharging (35, 36) conveyors of the two production tracks (12, 13) are not arranged symmetrically relative to the longitudinal mid-plane of the machine, but are transversely off-set in parallel relative to said mid-plane, so that the cigarettes in both of the two production tracks (12, 13) are always arranged, fed and discharged in the same orientation of the cigarettes.

2. Packaging machine according to claim 1, characterized in that the cigarette-feeding conveyor (27) for feeding cigarette groups (22) to the receiving turret (14) of one production track (12) extends in an inner longitudinal plane between the receiving turret (14) in said one production track (12) and said common supporting stand (11), and in that the corresponding cigarette-feeding conveyor (28) of the other production track (13) extends in an outer longitudinal plane transversely off-set outwards relative to both the supporting stand (11) and the receiving turret (14) in said other production track (13).

3. Packaging machine according to claim 2, characterized in that the receiving turret (14), tin foil-folding turret (15), paper-folding turret (16) and, drying turret (17) of each production track (12, 13) are driven by means of an appropriately assigned stepping gear (40, 41) which acts on a drive shaft (38, 39) of the paper-folding turrets (16), the further turrets, including the receiving turret (14), tin foil-folding turret (15) and drying turret (17), being engaged, via driving gear-wheels (47, 48), within the housing (11) to a main gear-wheel (46) on the drive shaft (38, 39).

4. Packaging machine according to claim 2, wherein the cigarette magazine (23) of said one production track (12) is located between said cigarette-feeding conveyor (27) and said mid-plane of the machine, and wherein the cigarette magazine (24) of said other production track (13) is located transversely outwardly from the corresponding cigarette-feeding conveyor (28).

5. Packaging machine according to claim 4, characterized in that the cigarette pack-discharging conveyor (35) for feeding cigarette packs to said common collecting track (37) extends in an inner longitudinal plane between said common supporting stand (11) and said drying turret (17) in said one production track (12); and in that the cigarette pack-discharging conveyor (36) of said other production track (13) extends in an outer longitudinal plane transversely offset outwards relative to both the supporting stand (11) and the drying turret (17) in said other production track (13).

6. Packaging machine according to claim 5, characterized in that the supporting stand is a housing (11) containing drives for all of the turrets in both production tracks (12, 13).

7. Packaging machine according to claim 6, characterized in that the drives of the two production tracks are independent of one another.

8. Packaging machine according to claim 6, characterized in that there is a common gear in said housing, and said drives are individually decouplable from said common gear.

* * * * *